US006845528B2

(12) United States Patent
Bantz

(10) Patent No.: US 6,845,528 B2
(45) Date of Patent: Jan. 25, 2005

(54) TEST PLUG ASSEMBLY FOR A BATH TUB

(75) Inventor: Shannon R. Bantz, Michigan City, IN (US)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 10/351,229

(22) Filed: Jan. 24, 2003

(65) Prior Publication Data

US 2004/0143892 A1 Jul. 29, 2004

(51) Int. Cl.[7] ..... E03C 1/244
(52) U.S. Cl. ..... 4/694; 4/295
(58) Field of Search ..... 4/255.07, 295, 4/694; 138/90

(56) References Cited

U.S. PATENT DOCUMENTS

| | | | | |
|---|---|---|---|---|
| 213,862 A | * | 4/1879 | Blunt | 4/694 |
| 1,281,222 A | * | 10/1918 | Stephanchak | 4/694 |
| 1,985,813 A | * | 12/1934 | Baden | 134/166 C |
| 2,036,614 A | * | 4/1936 | Tharp | 4/255.07 |
| 6,062,262 A | | 5/2000 | Tash | 138/89 |
| 6,289,935 B1 | | 9/2001 | Tash | 138/97 |

* cited by examiner

*Primary Examiner*—Charles E. Phillips
(74) *Attorney, Agent, or Firm*—Greer, Burns & Crain, Ltd.; Philip M. Kolehmainen

(57) ABSTRACT

For pressure testing a drain and vent piping system communicating with a tub opening having an anchoring structure a plug has a central, axially extending aperture therethrough. The plug has a resilient, compressible portion and is provided with inner and outer ends. An anchor is located at the inner end of the plug and extends axially beyond the inner end to engage with the anchoring structure and seal the tub opening. The test plug assembly also includes a threaded shaft that passes through the aperture in the plug and connects to the anchor. A manually operated threaded actuator is located at the outer end of the plug and is configured for threadingly engaging the shaft to draw the actuator towards the anchor and compress the compressible portion of the plug to block fluid flow through the bath tub opening and permit pressure testing of the drain and vent piping system. The manually operated threaded actuator can be rotated to disengage the actuator from the threaded shaft and permit the removal of the test plug assembly from the tub opening.

21 Claims, 3 Drawing Sheets

TEST PLUG ASSEMBLY FOR A BATH TUB

FIELD OF THE INVENTION

The present invention relates to improved test plug assemblies for blocking fluid flow through bath tub drain and overflow openings.

DESCRIPTION OF THE PRIOR ART

Upon construction of new homes and other structures, the drain and vent piping systems may be subject to a requirement for leakage testing, for example by filling the piping system with water and inspecting for leakage or by applying air pressure within the piping system and determining if the pressure remains constant. In either case, the openings from the piping system to the surrounding atmosphere must be closed. Among the openings that must be sealed are the drain, or waste opening and the overflow opening of any bath tub served by the piping system. For leakage testing, test plugs are conventionally used to close the bath tub openings.

Known test plugs for closing openings such as found in conventional bath tubs include a deformable, elastomeric, annular body having a diameter sized to fit into a tub opening to be sealed. The deformable body is sandwiched between opposed metal pressure plates. A threaded shaft and nut, such as a wing nut, are used to draw the plates together. This causes the deformable body to expand radially into sealing engagement with the wall of the tub opening.

A conventional bath tub includes drain and overflow openings having walls of substantial length that are generally right circular cylinders without significant taper. The conventional test plug functions well with walls of this configuration because the force of the radially expanded deformable body engages the walls with sufficient force and over a sufficient area of contact to withstand substantial water or air pressure during leakage testing. However, some tubs have openings with tapered or rounded walls or walls that are not of substantial length. The conventional test plug does not function reliably with such openings. Thus, there is a need for test plug assemblies that can be used with bath tub openings that have tapered or rounded or truncated walls.

SUMMARY OF THE INVENTION

An object of the present invention is to provide improved test plug assemblies that can be used with bath tub drain openings of various configurations. Other objects are to provide test plug assemblies that are durable, compact, inexpensive, easy to use, and easily removed from a bath tub opening.

In brief, a test plug assembly in accordance with the present invention is used with a bath tub opening having an anchoring structure and includes a plug having a central, axially extending aperture. The plug has a resilient, compressible portion. An anchor is located at an inner end of the plug and extends axially beyond the inner end of the plug for engagement with the anchoring structure of the tub opening. A threaded shaft passes through the aperture in the plug and is connected to the anchor. A manually operated threaded actuator is located at an outer end of the plug and threadingly engages the threaded shaft. The actuator rotates about the threaded shaft and draws the actuator toward the anchor to compress the compressible portion of the plug for sealing of the tub opening.

BRIEF DESCRIPTION OF THE DRAWINGS

The present invention together with the above and other objects and advantages may best be understood from the following detailed description of the preferred embodiments of the invention illustrated in the drawings, wherein.

DESCRIPTION OF THE PREFERRED EMBODIMENTS

Figure 1:
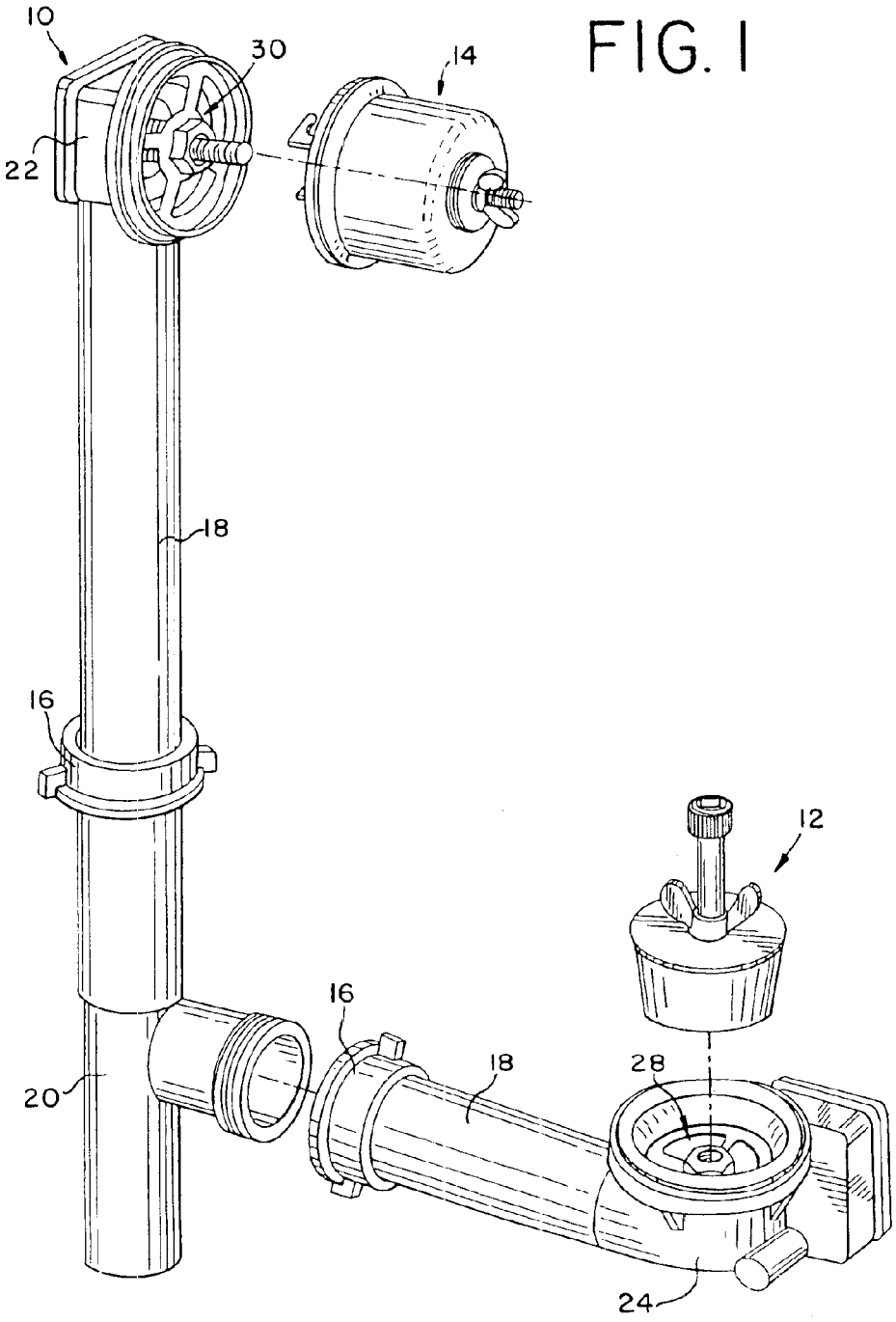
FIG. 1 is an isometric view of a part of a drain and vent piping system communicating with drain or waste and overflow bath tub openings each receiving a different test plug assembly in accordance with present invention.

Having reference now to the drawing, FIG. 1 illustrates part of a drain and vent piping system designated as a whole as 10 and provided in accordance with the present invention with an improved first embodiments test plug assembly, generally designated as 12, and a second embodiment test plug assembly, generally designated as 14. The drain and vent piping system 10 has connectors 16 that connect straight and T-shaped drain pipe tubular portions 18 and 20, respectively, to one another. Additionally, an upper end portion 22 and a lower end portion 24 of the drain and vent piping system 10 are correspondingly sized to form water overflow and drain passages of a bath tub 26 (FIGS. 2 and 5), and include a lower bath tub drain or waste opening, generally designated as 28, and an upper bath tub overflow opening, generally designated as 30. These openings 28 and 30 drain water from the bath tub via the drain and vent piping system 10.

Figure 2:
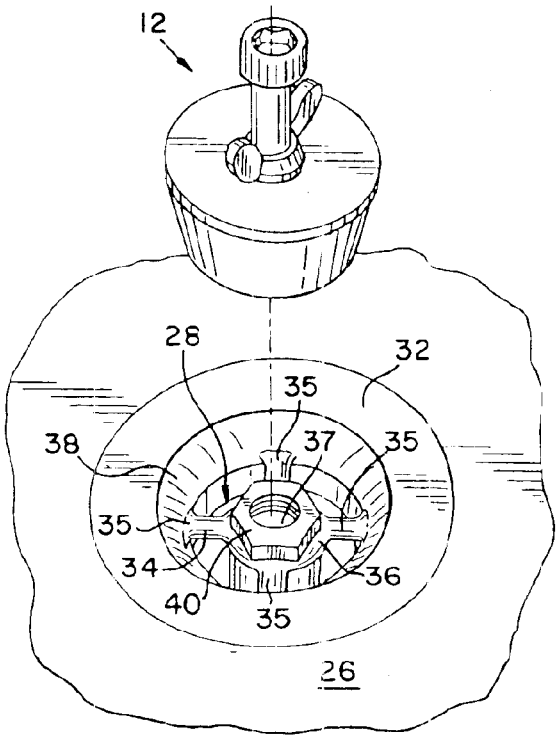
FIG. 2 is an isometric view of the drain bath tub opening together with a test plug assembly that is a first embodiment of the present invention.
Figure 3:
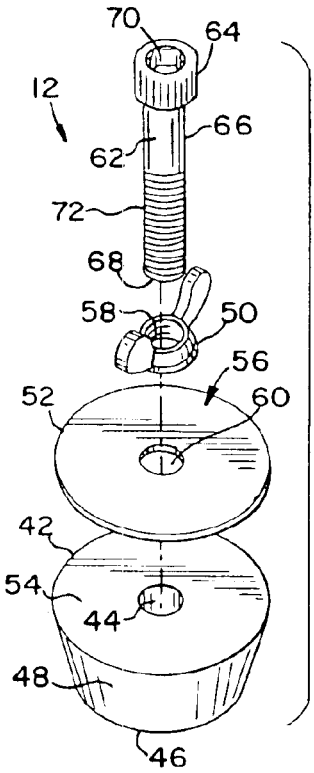
FIG. 3 is an exploded isometric view of the test plug assembly of FIG. 2.
Figure 4:
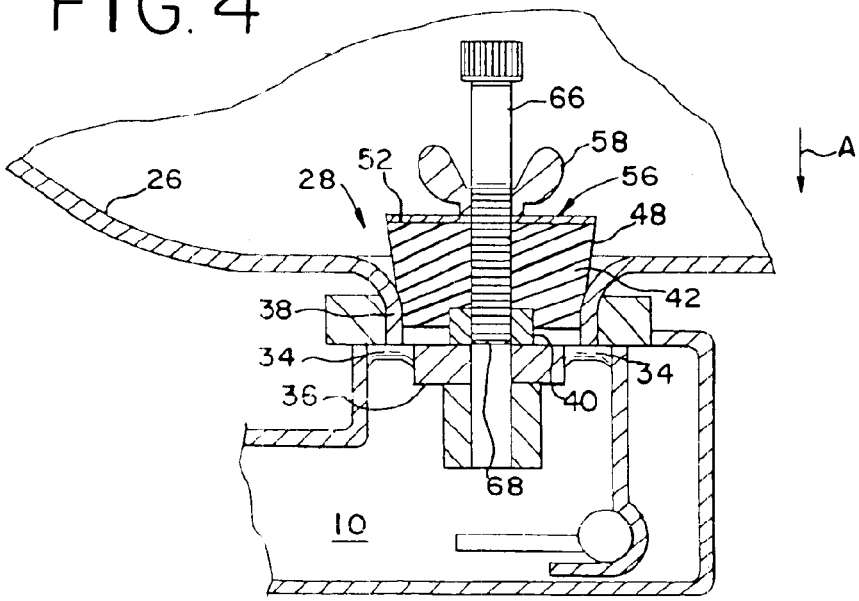
FIG. 4 is an axial cross-sectional view of the test plug assembly of FIG. 2 shown positioned in the bath tub drain opening.

FIGS. 2–4 show the first embodiment of the test plug assembly 12 for blocking fluid flow through a bath tub strainer 32 positioned in the lower opening 28 to permit pressure testing of the drain and vent piping system 10 of FIG. 1. The strainer 32 includes an anchoring structure 34 that has four radial members 35 extending from a ring or circular portion 36 that defines an axially extending aperture 37 configured for receiving a post or shaft of a stopper or plunger (not shown) that closes against the strainer 32 when the user desires to fill the tub 26. The outer ends of the radial members 35 are connected to an inner surface or cylindrically-shaped sidewall 38 of the bath tub strainer 32 which forms the lower bath tub opening 28. The rounded and axially truncated shape of the sidewall 38 cannot reliably receive a conventional test plug assembly.

The lower bath tub opening 28 is formed in the generally horizontal bottom wall of tub 26 and communicates with the drain and vent piping system 10 to enable fluid drainage from the bath tub 26. Within the lower bath tub opening 28 is the anchoring structure 34 which has a female threaded structure, such as a threaded nut 40, that operates as an anchor receiving member and is attached (e.g., by welding or other known fastening methods) to the circular portion 36.

Preferably, the circular portion 36 and female threaded structure 40 are centrally located in the lower opening 28 to facilitate engagement to the plunger and the test plug assembly 12. The inner thread diameter of the structure 34 or nut 40 is large enough to accommodate the post or shaft of a plunger or stopper.

The test plug assembly 12 includes a plug 42 having a central, axially extending aperture 44 as seen in FIG. 3. The plug 42 includes an inner end 46 and a resilient, compressible portion or body of elastomeric material 48 that engages the wall 38 of the bath tub strainer 32 to block fluid flow through the lower bath tub opening 28 to permit pressure testing of the drain and pipe venting system 10. By way of example, the resilient, compressible portion 48 can be formed of a rubber material or the like. The test plug assembly 12 also includes a manually operated threaded actuator, such as a wing nut 50, and a flat washer 52 interposed between a top surface 54 of the resilient portion 48 and the wing nut. The wing nut 50 is located at an outer end of the plug, shown generally as 56.

As seen in FIG. 3, the wing nut 50 and the flat washer 52 include central, axially extending apertures 58 and 60, respectively, that are aligned with the central, axially extending aperture 44 of the plug 42 to receive a fastening member 62. The fastening member 62 has a head portion 64 and a threaded shaft 66 which includes a threaded inner end portion 68. The head portion 64 projects away from the outer end 56 beyond the wing nut 50. A recessed portion 70 of the head portion 64 is configured for receiving an Allen wrench or the like to facilitate rotating of the fastening member 62. The threaded shaft 66 is an anchor or male thread portion 72 that is configured for threading through the wing nut 50, the flat washer 52, and the resilient portion 48 to at least partially extend axially beyond the inner end 46 of the plug 42 and engage the anchoring structure 34.

In use, the head portion 64 is used to thread the anchor portion 72 of the member 62 into the thread structure 40 of the anchoring structure 34. This positions the plug 42 in axial alignment above the strainer 32 and wall 38. Then the wing nut 50 is tightened to force the washer 52 toward the anchoring structure 34. As best seen in FIG. 4, fluid flow between the bath tub 26 and the drain and vent piping system 10 through the lower bath tub opening 28 is blocked when the test plug assembly 12 has the anchor 72 threaded onto the nut 40 and the wing nut 58 is rotated about the threaded shaft 66. Preferably, the wing nut 58 is located at the outer end 56 of the plug 42 and threadingly engages the threaded shaft 66 to draw the actuator toward the anchor 72 in the direction of an arrow A and compress the compressible portion 48 of the plug into sealing contact with the wall 38. The compressible portion 48 has a circumferential snug friction fit against the cylindrically-shaped sidewall 38 to seal the lower bath tub opening 28.

Figure 5:
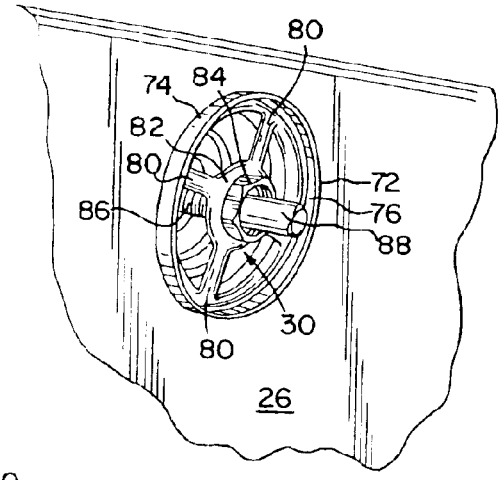
FIG. 5 is an isometric view of the overflow bath tub opening together with a test plug assembly that is a second embodiment of the present invention.
Figure 6:
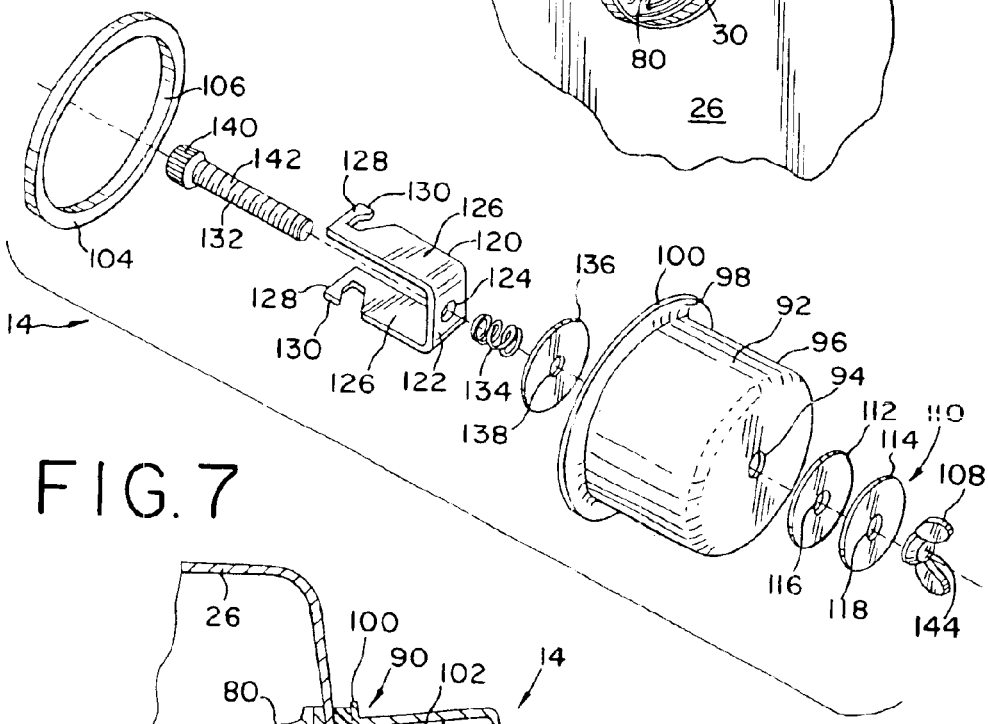
FIG. 6 is an exploded isometric view of the test plug assembly of FIG. 5.
Figure 7:
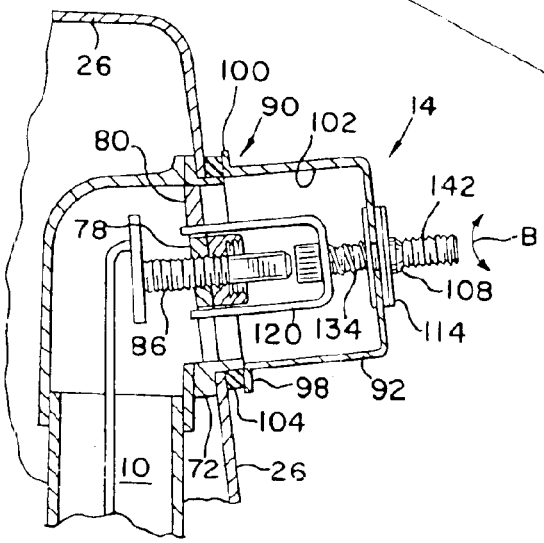
FIG. 7 is a axial cross-sectional view of the test plug assembly of FIG. 5 shown positioned in the bath tub overflow opening.

The upper portion 22 of the drain and vent piping system 10 as seen in FIGS. 5–7 includes an overflow flange 72 that includes the upper bath tub opening 30 of the bath tub 26. The overflow opening 30 is formed in a generally vertical side or end wall of the tub 26. The overflow flange 72 has a cylindrically-shaped outer surface 74 for receiving the second embodiment test plug assembly 14 and an inner surface 76. An anchoring structure 78 positioned within the upper bath tub opening 30 has four radial arm members 80 that connect at their outer ends to the inner surface 76 and at their inner ends to a circular central portion 82. A fitting 84 is attached to the circular portion 82 and receives a handle drive shaft 88. The handle drive shaft 88 is configured to receive an adapter plate and molded handle, or a one piece metal handle (not shown) to operate a cable (also not shown) that controls the raising and lowering of the stopper or plunger into and out of the lower bath tub opening 28 of FIG. 2.

The upper bath tub opening 30 provides fluid overflow protection by communicating with the drain and vent piping system 10 to enable fluid drainage from the bath tub 26 when the fluid in the bath tub rises to the upper bath tub opening. Preferably, for aesthetic reasons, the circular portion 82 and the handle drive shaft 88 are centrally located in the upper bath tub opening 30 to enable the molded handle to shield the upper bath tub opening 30 and the anchoring structure 78 when viewed from within the bath tub 26. The shape of the overflow opening 30 and overflow flange 72 does not accommodate a conventional test plug assembly.

As seen in FIGS. 6 and 7, the test plug assembly 14 includes a plug indicated generally as 90. The plug 90 includes a cylindrical member 92 that has a central, axially extending aperture 94 and an outer surface 96 defining an outer periphery 98 of an inner end 100 of the plug. The cylindrical member 92 also has an inner surface 102 that receives a resilient, compressible portion, such as an elastomeric ring 104, of the plug 90.

An inner surface 106 of the elastomeric ring 104 is sized to surround the outer surface 74 of the overflow flange 72 and to engage the surrounding tub wall to block fluid flow through the upper bath tub opening 30 as shown in FIG. 7. The ring 104 may contact the surface 74 as seen in FIG. 7, or may be spaced outwardly from the surface 74. The elastomeric ring 104 is compressed against the wall of the bath tub 26 by a manually operated threaded actuator, such as wing nut 108, located at an outer end, shown generally as 110, of the plug 90. A pair of flat washers 112 and 114, which include respective centrally located apertures 116 and 118, are positioned between the wing nut 108 and the cylindrical member 92. If desired a single steel-rubber sealing washer can be used in place of the washers 112 and 114.

The test plug assembly 14 also includes an anchor for engaging the anchoring structure 78 of FIG. 5, such as a hook member 120, which preferably comprises a generally U-shaped component. However, it is contemplated that the anchor may have other shapes. The hook member 120 includes a bight portion 122 that has a threaded opening 124 therethrough and two leg portions 126. Hooks 128 are configured to engage opposed radial arm members 80 of the anchoring structure 78 (FIG. 7) and are defined at each of the ends 130 of the leg portions 126.

The second embodiment test plug assembly 14 also includes a threaded member 132, a spring 134, and a third flat washer 136 that has a centrally located aperture 138 therethrough. The threaded member 132 is provided with a head portion 140 and a threaded shaft 142 that engages the threaded opening 124 and the wing nut 108. The spring 134 is positioned between the third washer 136 and the bight portion 122 of the hook member 120 and biases the inner end 100 of the plug 90 apart from the bight portion 122. Upon assembly of the plug 90, the threaded shaft 142 of the threaded member 132 passes though the aperture 124 of the hook member 120, the spring 134, the apertures 138, 94, 116, and 118 respectively, to engage a threaded aperture 144 of the wing nut 108. The spring 134 engages the inner end 100 of the plug 90 to hold the plug 90 perpendicular to the threaded member 132.

In use, the wing nut 108 is initially threaded outward, toward the free end of the member 132. The hook member 120 is held against rotation and moves axially out from the cylindrical member 92. In this position, the hooks 128 extend well beyond the inner end 100 of the plug 90. Then the test plug assembly 14 is placed against the tub wall and around the overflow opening 30. The hooks 128 are received between the radial arms 80. The wing nut 108 is turned and the hook member 120 rotates until the hooks 128 catch an opposed pair of radial arms 80. The contact of the hooks 128 against the arms 80 prevents further rotation of the hook member 120. As the wing nut 108 is further tightened, the member 92 and hook member 120 are drawn toward one another and the ring 104 is compressed into sealing engagement against the wall of the tub 26.

While the present invention has been described with reference to the details of the embodiments of the invention shown in the drawing, these details are not intended to limit the scope of the invention as claimed in the appended claims.

What is claimed is:

1. A test plug assembly for blocking fluid flow through a bath tub opening to permit pressure testing of a drain and vent piping system communicating with the tub opening, the tub opening including an anchoring structure, said test plug assembly comprising:

a plug having a central, axially extending aperture and having inner and outer ends, said plug including a resilient, compressible portion;

an anchor located at said inner end of said plug and extending axially beyond said inner end of said plug for engagement with the anchoring structure;

a threaded shaft passing through said aperture in said plug, said shaft being connected to said anchor; and a manually operated threaded actuator located at said outer end of said plug and threadedly engaging said shaft, said actuator being rotatable to draw said actuator toward said anchor for compressing said compressible portion of said plug;

wherein said plug is biased apart from said anchor.

2. The test plug assembly as claimed in claim 1, said actuator comprising a wing nut threaded onto said shaft.

3. The test plug assembly as claimed in claim 2, said anchor comprising a threaded inner end portion of said shaft.

4. The test plug assembly as claimed in claim 3, said compressible portion comprising a body of elastomeric material and a flat washer interposed between said body and said wing nut.

5. The test plug assembly as claimed in claim 4, said shaft including a head portion projecting away from said outer end beyond said wing nut.

6. The test plug assembly as claimed in claim 2, said anchor comprising a hook member.

7. A test plug assembly for blocking fluid flow through a bath tub opening to permit pressure testing of a drain and vent piping system communicating with the tub opening, the tub opening including an anchoring structure, said test plug assembly comprising:

a plug having a central, axially extending aperture and having inner and outer ends, said plug including a resilient, compressible portion;

an anchor located at said inner end of said plug and extending axially beyond said inner end of said plug for engagement with the anchoring structure said anchor comprising a hook member;

a threaded shaft passing through said aperture in said plug, said shaft being connected to said anchor; and a manually operated threaded actuator in the form of a wing nut located at said outer end of said plug and threadedly engaging said shaft, said actuator being rotatable to draw said actuator toward said anchor for compressing said compressible portion of said plug said hook member comprising a generally U-shaped component with said shaft passing through a bight portion of said U-shaped component and a hook defined at an end of each leg portion of said U-shaped component.

8. The test plug assembly as claimed in claim 7, said compressible portion comprising a resilient ring located at an outer periphery of said inner end of said plug.

9. A system for blocking fluid flow through a bath tub opening to permit pressure testing of a drain and vent piping system communicating with the tub opening, said testing system comprising:

a bath tub having an anchoring structure in the bath tub opening, said anchoring structure having opposed radial arm members;

a plug having a central, axially extending aperture and having inner and outer ends, said plug including a resilient, compressible portion;

a threaded shaft passing through said aperture in said plug, said shaft being connected to said anchoring structure; and a manually operated threaded actuator located at said outer end of said plug and threadedly engaging said shaft, said actuator being rotatable to draw said actuator toward said anchoring structure for compressing said compressible portion of said plug; and an anchor located at said inner end of said plug and extending axially beyond said inner end of said plug for engagement with the anchoring structure, said anchor having hooks that are configured to engage said opposed radial arm members, and wherein said plug is biased apart from said anchor.

10. A system for blocking fluid flow through a bath tub opening to permit pressure testing of a drain and vent piping system communicating with the tub opening, said testing system comprising:

a bath tub having an anchoring, structure in the bath tub opening; a plug having a central, axially extending aperture and having inner and outer ends, said plug including a resilient, compressible portion;

an anchor having an aperture therethrough and located at said inner end of said plug to extend axially beyond said inner end of said plug for engagement with said anchoring structure;

a threaded shaft passing through said aperture in said plug, said shaft being connected to said anchoring structure; and a manually operated threaded actuator located at said outer end of said plug and threadedly engaging said shaft, said actuator being rotatable to draw said actuator toward said anchor for compressing said compressible portion of said plug, wherein said plug is biased apart from said anchor.

11. A test plug assembly for blocking fluid flow through a bath tub opening to permit pressure testing of a drain and vent piping system communicating with the tub opening, the tub opening including an anchoring structure having opposed radial arm members, said test plug assembly comprising:

a plug having a central, axially extending aperture and having inner and outer ends, said plug including a resilient, compressible portion;

a threaded shaft passing through said aperture in said plug, said shaft being connectable to the anchoring structure; and a manually operated threaded actuator located at said outer end of said plug and threadedly engaging said shaft, said actuator being rotatable to draw said actuator toward said anchoring structure for compressing said compressible portion of said plug; and an anchor located at said inner end of said plug and extending axially beyond said inner end of said plug for engagement with the anchoring structure, said anchor having hooks that are configured to engage said opposed radial arm members, and wherein said plug is biased apart from said anchor.

12. The test plug assembly as claimed in claim 11, said actuator comprising a wing nut threaded onto said shaft.

13. The test plug assembly as claimed in claim 12, said compressible portion comprising a body of elastomeric material and wherein a flat washer is interposed between said body and said wing nut.

14. The test plug assembly as claimed in claim 13, said shaft including a head portion projecting away from said outer end beyond said wing nut.

15. A test plug assembly for blocking fluid flow through a bath tub opening to permit pressure testing of a drain and vent piping system communicating with the tub opening, the tub opening including an anchoring structure, said test plug assembly comprising:

a plug having a central, axially extending aperture and having inner and outer ends, said plug including a resilient, compressible portion;

an anchor biased apart from said plug and extending axially beyond said inner end of said plug for engagement with the tub opening anchoring structure;

a threaded shaft passing through said aperture in said plug, said shaft being connected to said anchor; and a manually operated threaded actuator located at said outer end of said plug and threadedly engaging said shaft, said actuator being rotatable to draw said actuator toward said anchor for compressing said compressible portion of said plug.

16. The test plug assembly as claimed in claim 15, said actuator comprising a wing nut threaded onto said shaft.

17. The test plug assembly as claimed in claim 16, said compressible portion comprising a resilient ring located at an outer periphery of said inner end of said plug.

18. The test plug assembly as claimed in claim 17, said shaft including a head portion projecting away from said outer end beyond said wing nut.

19. The test plug assembly as claimed in claim 18, said anchor comprising a hook member.

20. The test plug assembly as claimed in claim 19, further comprising a spring biasing said anchor apart from said plug.

21. The test plug assembly as claimed in claim 20, said hook member comprising a generally U-shaped component with said shaft passing through a bight portion of said U-shaped component and a hook defined at an end of each leg portion of said U-shaped component.

* * * * *